US005666146A

United States Patent [19]

Mochizuki et al.

[11] Patent Number: 5,666,146

[45] Date of Patent: Sep. 9, 1997

[54] INK CARTRIDGE FOR INK JET RECORDING APPARATUS

[75] Inventors: Seiji Mochizuki; Kazuhisa Kawakami; Masahiro Isono, all of Nagano, Japan

[73] Assignee: Seiko Epson Corporation, Tokyo, Japan

[21] Appl. No.: 295,040

[22] Filed: Aug. 25, 1994

Related U.S. Application Data

[63] Continuation of Ser. No. 888,369, May 26, 1992, abandoned.

[30] Foreign Application Priority Data

| | | | |
|---|---|---|---|
| May 27, 1991 | [JP] | Japan | 3-121136 |
| Jul. 8, 1991 | [JP] | Japan | 3-166854 |
| Jul. 8, 1991 | [JP] | Japan | 3-166855 |
| Jul. 8, 1991 | [JP] | Japan | 3-166856 |

[51] Int. Cl.[6] ..... B41J 2/175

[52] U.S. Cl. ..... 347/86

[58] Field of Search ..... 347/36, 86, 87; 222/92, 105, 183

[56] References Cited

U.S. PATENT DOCUMENTS

| | | | |
|---|---|---|---|
| 3,913,774 | 10/1975 | Vajtay . | |
| 4,303,929 | 12/1981 | Blanck | 347/86 |
| 4,335,950 | 6/1982 | Gunzelmann et al. | 271/273 |
| 4,551,734 | 11/1985 | Causley et al. | 346/140 R |
| 4,577,203 | 3/1986 | Kasamura | 346/140 R |
| 4,928,126 | 5/1990 | Asai | 347/86 |
| 4,974,977 | 12/1990 | Morgan et al. . | |
| 5,307,091 | 4/1994 | DeCoste, Jr. | 347/86 |

FOREIGN PATENT DOCUMENTS

| | | | |
|---|---|---|---|
| 2192591 | 1/1988 | European Pat. Off. . | |
| 364 284 | 4/1990 | European Pat. Off. . | |
| 0364284 | 4/1990 | European Pat. Off. . | |
| 380 199 | 8/1990 | European Pat. Off. . | |
| 440 261 | 8/1991 | European Pat. Off. . | |
| 2 485 991 | 7/1981 | France . | |
| 2485991 | 1/1982 | France . | |
| 58-211482 | 12/1983 | Japan . | |
| 59-212272 | 12/1984 | Japan . | |
| 59-227458 | 12/1984 | Japan | 347/86 |
| 60125671 | 7/1985 | Japan . | |
| 60-125671 | 7/1985 | Japan . | |
| 62-60334 | 4/1987 | Japan . | |
| 62-60335 | 4/1987 | Japan . | |
| 63-4953 | 1/1988 | Japan | 347/86 |
| 63-296956 | 12/1988 | Japan . | |
| 1-141749 | 6/1989 | Japan . | |
| 1180351 | 7/1989 | Japan . | |
| 2187349 | 7/1990 | Japan . | |
| 2-192953 | 7/1990 | Japan . | |

OTHER PUBLICATIONS

Patent Abstracts of Japan, vol. 9, No. 57 (M-363), Mar. 1985.

Patent Abstracts of japan, vol. 13, No. 462 (M-881), Oct. 1989.

Patent Abstracts of Japan, vol. 14, No. 469 (M-1034), Jul. 1990.

Patent Abstracts of Japan, vol. 8, No. 61 (M-284), Mar. 1984.

Patent Abstracts of Japan, vol. 9, No. 282 (M-428), Nov. 1985.

*Primary Examiner*—John E. Barlow, Jr.

*Attorney, Agent, or Firm*—Sughrue, Mion, Zinn, Macpeak & Seas

[57] ABSTRACT

An ink cartridge employable for an ink jet type recording apparatus includes a fitting portion (4*b*) at the central part of a front plate (4*a*) of a case (4) so as to allow an ink outlet piece (2) secured to an ink bag (1) to be engaged with the fitting portion (4*b*). Once the ink outlet piece (2) is engaged with the fitting portion (4*b*), the ink bag (1) is located and received in the case (4). In addition, when two position determining shafts projecting from the innermost end of the cartridge holder are inserted through position determining holes (4*g*) and (4*h*) on the front plate (4*a*) of the case (4), an ink feeding needle projection from the innermost end of the cartridge holder is correctly located in alignment with the ink outlet piece (2) while the front plate (4) of the case serves as a reference.

20 Claims, 7 Drawing Sheets

INK CARTRIDGE FOR INK JET RECORDING APPARATUS

This is a continuation of application Ser. No. 07/888,369 filed May 26, 1992, now abandoned.

BACKGROUND OF THE INVENTION

The present invention relates to an ink cartridge for use with an ink jet recording apparatus that performs a recording operation by jetting a series of ink droplets onto a recording paper through a nozzle.

Various kinds of ink feeding systems for an ink jet recording apparatus of the aforementioned type have been hitherto proposed and put to practical use.

To facilitate understanding of the present invention, a conventional ink cartridge having a flexible ink bag received therein and a mechanism for installing the ink cartridge will briefly be described below with reference to FIG. 7 and FIG. 8.

The ink cartridge includes an ink bag a, and a tubular ink outlet piece b is integrated with the ink bag a by applying thermal fusion on one of the thermally fused sides (represented by hatched lines), thereby to allow ink in the ink bag a to be conducted to the outside through the ink outlet piece b. To fixedly hold the ink bag a at a predetermined position in a case e, the ink outlet piece bis provided with a pair of flanges c through which holes d are formed. Thus, the ink bag a can be positioned and fixedly received in the case e by fitting a pair of projections f on the front end part of the case e into the holes d. In addition, the ink cartridge includes a cover j which is placed on the opening of the case e. The cover j is integrated with the case e by thermally sealing the peripheral edge of the case e using an ultrasonic welding process.

A holder m having the case e received therein is fixedly mounted on an ink jet recording apparatus (not shown). The holder m includes a pair of frames n on the opposite sides thereof so as to guide slidable insertion of the ink cartridge h composed of the ink bag a and the case e. In addition, the holder m includes a pair of leaf springs p at the innermost end of the frame n. When ribs i on the opposite side walls of the ink cartridge h are engaged with the leaf springs p, the ribs i are fixedly retained by the leaf springs p. At this time, an ink feeding needle q projecting from the ink jet recording apparatus is ready to pierce the central part of the ink outlet piece b.

With such construction, the positional relationship between the ink feeding needle g and the opposing pair of frames n, the positional relationship between the leaf springs p and the ribs i and the positional relationship between the case e and the ink outlet piece b are liable to be undesirably disturbed during steps of fitting and assembling. Thus, there is left unsolved a problem that the ink feeding needle g sometimes cannot be correctly located in alignment with the ink outlet piece b.

In addition, if the cover j is removed from the case e, it is difficult as a practical matter to reunite the former with the latter again such as by employing a thermal fusion process. For this reason, the ink cartridge h cannot repeatedly be used. Further, since the ink outlet piece b is secured to the thermally fused surfaces of the ink bag a, there is left unsolved another problem that a certain gap appears between the ink outlet piece b and the thermally fused surfaces.

SUMMARY OF THE INVENTION

Accordingly, an object of the present invention is to provide an ink cartridge for an ink jet recording apparatus wherein an ink outlet piece can be correctly aligned with an ink feeding needle regardless of a slight positional deviation from their preferred positions.

Another object of the present invention is to provide an ink cartridge for an ink jet recording apparatus wherein a case and a cover placed on the opening of the case can repeatedly be used.

According to the present invention, there is provided an ink cartridge for an ink jet recording apparatus wherein the ink cartridge includes a fitting portion formed on a front plate of a case constituting the ink cartridge, the fitting portion serving to hold and locate an ink outlet piece in an engaged state by engaging the fitting portion with an engaging portion on the ink outlet piece and at least one position determining hole formed on the front plate of the case, the position determining hole serving to properly locate the ink cartridge relative to a cartridge holder by inserting a position determining shaft projecting from the innermost end of the cartridge holder through the position determining hole. With such construction, the ink feeding needle can be correctly located in alignment with the ink outlet piece with the front plate of the case serving as a reference.

To assure that the case and the cover can repeatedly be used, engagement holes are formed on the front plate of the case positioned so as to engage with the corresponding corner portions disposed on the front edge of a cover, and engagement portions are formed on the opposite side plates of the case at the rear end of the same positioned so as to engage with the corresponding pawls disposed on the opposite sides of the cover at the rear end of the same, whereby the cover can be repeatedly fitted to the case in a snap fit fashion.

Other objects, features and advantages of the present invention will become apparent from reading of the following description which has been made in conjunction with the accompanying drawings.

DESCRIPTION OF THE PREFERRED EMBODIMENTS

The present invention will hereinafter be described in detail with reference to the accompanying drawings, which illustrate preferred embodiments of the present invention.

Figure 1:
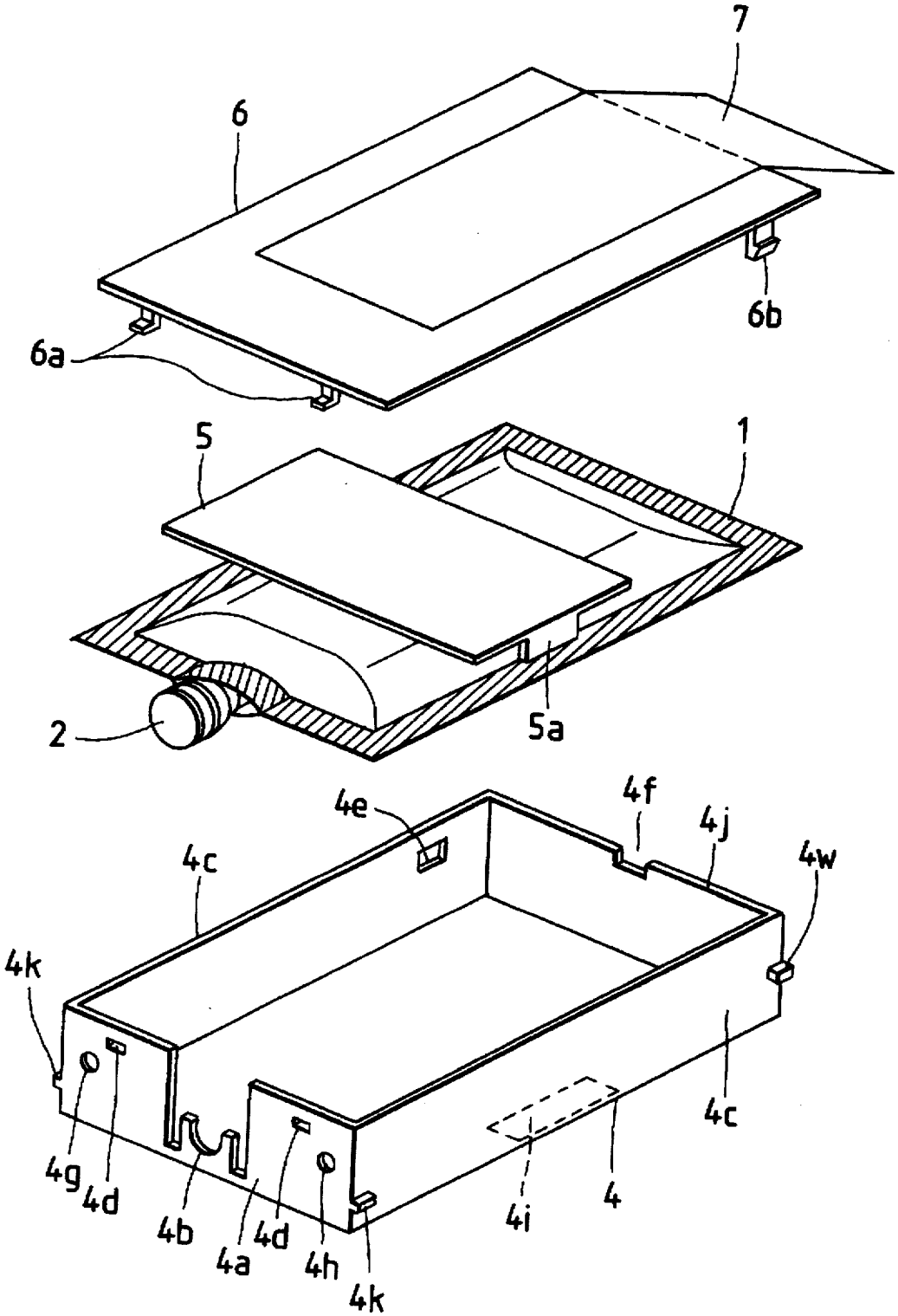
FIG. 1 is a perspective view of a preferred embodiment of an ink cartridge for an ink jet type recording apparatus constructed in accordance with the present invention, particularly illustrating the structure of the ink cartridge in a disassembled state.
Figure 2:
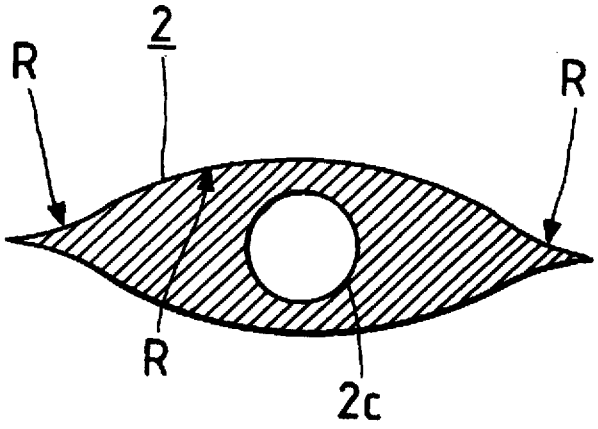
FIG. 2 is a cross-sectional view of an ink outlet piece to be secured to an ink bag.
Figure 3:
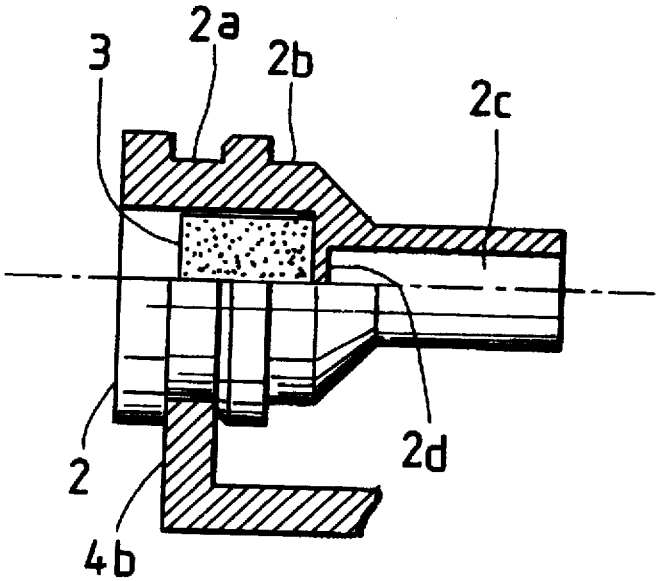
FIG. 3 is a sectional view of a position determining/engaging mechanism for the ink outlet piece.

FIG. 1 is a perspective view which illustrates an ink cartridge for an ink jet recording apparatus and which is constructed in accordance with a preferred embodiment of the present invention, FIG. 2 is a cross-sectional view of an ink outlet piece to be fitted to an ink bag, and FIG. 3 is a partially sectioned view of a position determining/engaging mechanism for the ink outlet piece.

The ink bag designated by reference numeral 1 is constructed using a laminated aluminum film which is laminated with two films such that the outside of the ink bag is lined with, e.g., a nylon film, while the inside of the same is lined with, e.g., a polyethylene film in order to improve the gas barrier property of the ink bag. These films are thermally fused together along the outer peripheral edge of the ink bag 1.

To conduct ink out of the ink bag 1 to the outside, an ink outlet piece 2 is integrated with the ink bag 1 by thermal fusion on the front side, as seen in FIG. 1. The ink outlet piece 2 is molded of a plastic material. As shown in FIG. 2, the rear part of the ink outlet piece 2, i.e., the joint location where the ink bag 1 is thermally fused with the ink outlet piece 2, is constructed in a leaf-shaped configuration such that the central part exhibits an convex arc having a large radius of curvature and the opposite ends exhibit an concave arc having a large radius of curvature. With this construction, a gap between the ink bag 1 and the ink outlet piece 2 is fully filled with molten material during a thermal fusing operation to provide a reliable seal.

The forward half of the ink outlet piece 2 has a circular sectional shape, and an annular engagement groove 2*a* for holding the ink bag 1 at a predetermined position on a case 4 (similar to the position determining annular engagement groove 2 disclosed in commonly assigned Japanese Examined Patent Application Publication (Kokai) No. Hei. 2-192953) is formed around the outer periphery of the ink outlet piece 2. A fitting portion 4*b* of the case 4 is fitted into the engagement groove 2*a* (see FIG. 3). In addition, a chuck portion 2*b* is formed around the central part of the ink outlet piece 2 so as to facilitate grasping of the ink bag 1 during a step of automatically receiving the ink bag 1 in the case 4 on a mass production line. A conduit 2*c* is formed along the center axis of the ink outlet piece 2 so as to conduct ink from the ink bag 1 to the outside. A sealing member 3 molded of an elastic material such rubber or the like is fitted into the forward end part of the ink outlet piece 2 so as to reliably maintain airtightness between the member 3 and an ink feeding needle 15 (to be described later). Further, a film portion 2*d* is interposed between the conduit 2*c* and the sealing member 3 in order to prevent incorrect printing from being performed due to undesirable elution or deposition of the rubber caused by direct contact of the ink with the sealing member 3.

Figure 4:
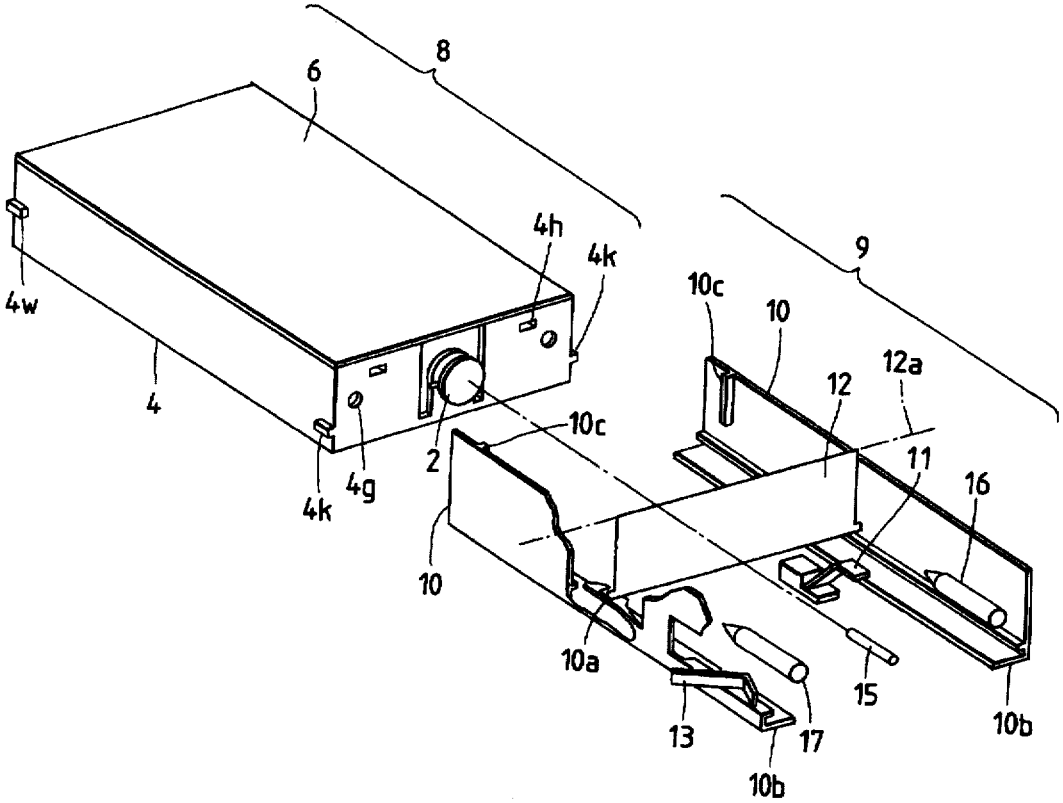
FIG. 4 is a perspective view of the ink cartridge and a holder, particularly illustrating the structure of the holder in a disassembled state.

The case 4 for receiving the ink bag 1 is designed in a box-shaped configuration having a small thickness. A fitting portion 4*b* having a semicircular recess to be engaged with the engagement groove 2*a* of the ink outlet piece 2 is formed on a front plate 4*a* of the case 4 in a snap-fit fashion. In addition, an opposing pair of position determining holes 4*g* and 4*h* are formed on the front plate 4*a* of the case 4 with the fitting portion located therebetween. As shown in FIG. 4, the case 4 is correctly held at a predetermined position as seen not only in the upward/downward direction but also in the leftward/rightward direction by inserting a position determining shaft 16 and a guide shaft 17 on a holder 9 into the position determining holes 4*g* and 4*h*.

Figure 6C:
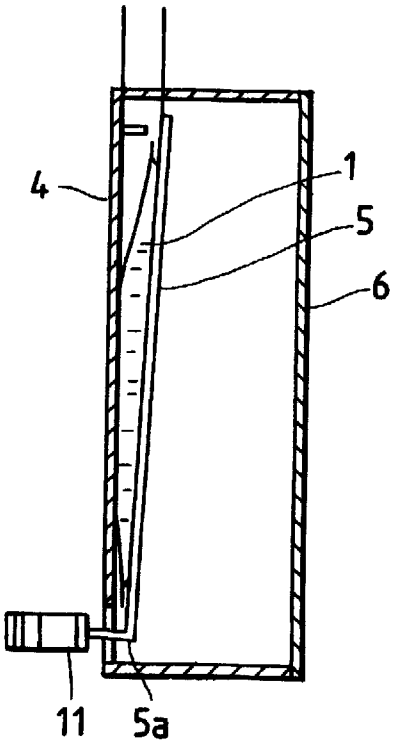
FIGS. 6(*a*)–6(*c*) are a sectional view of the ink cartridge particularly illustrating displacement of a detection plate in the ink cartridge.
Figure 6B:
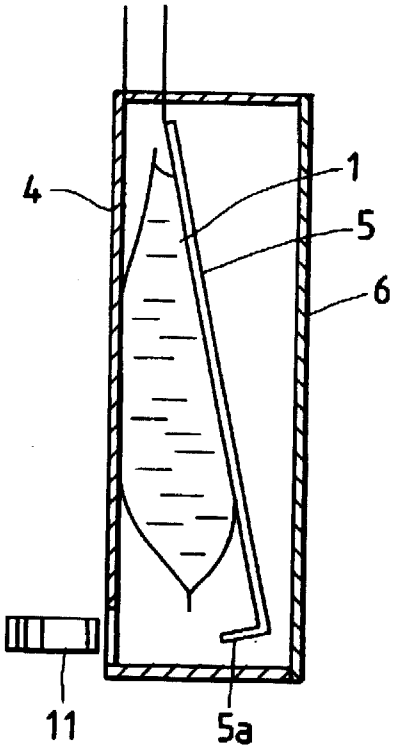
Figure 6A:
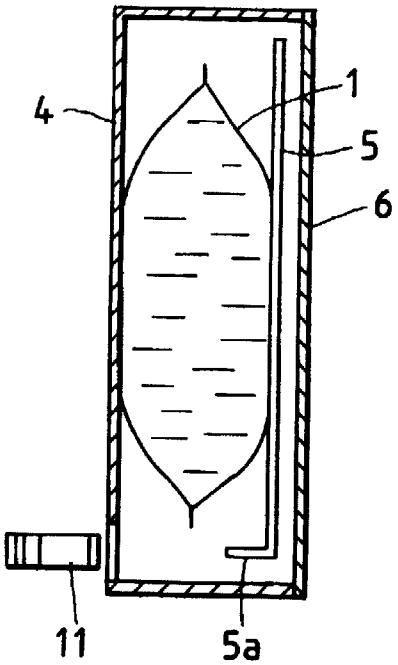
Figure 7:
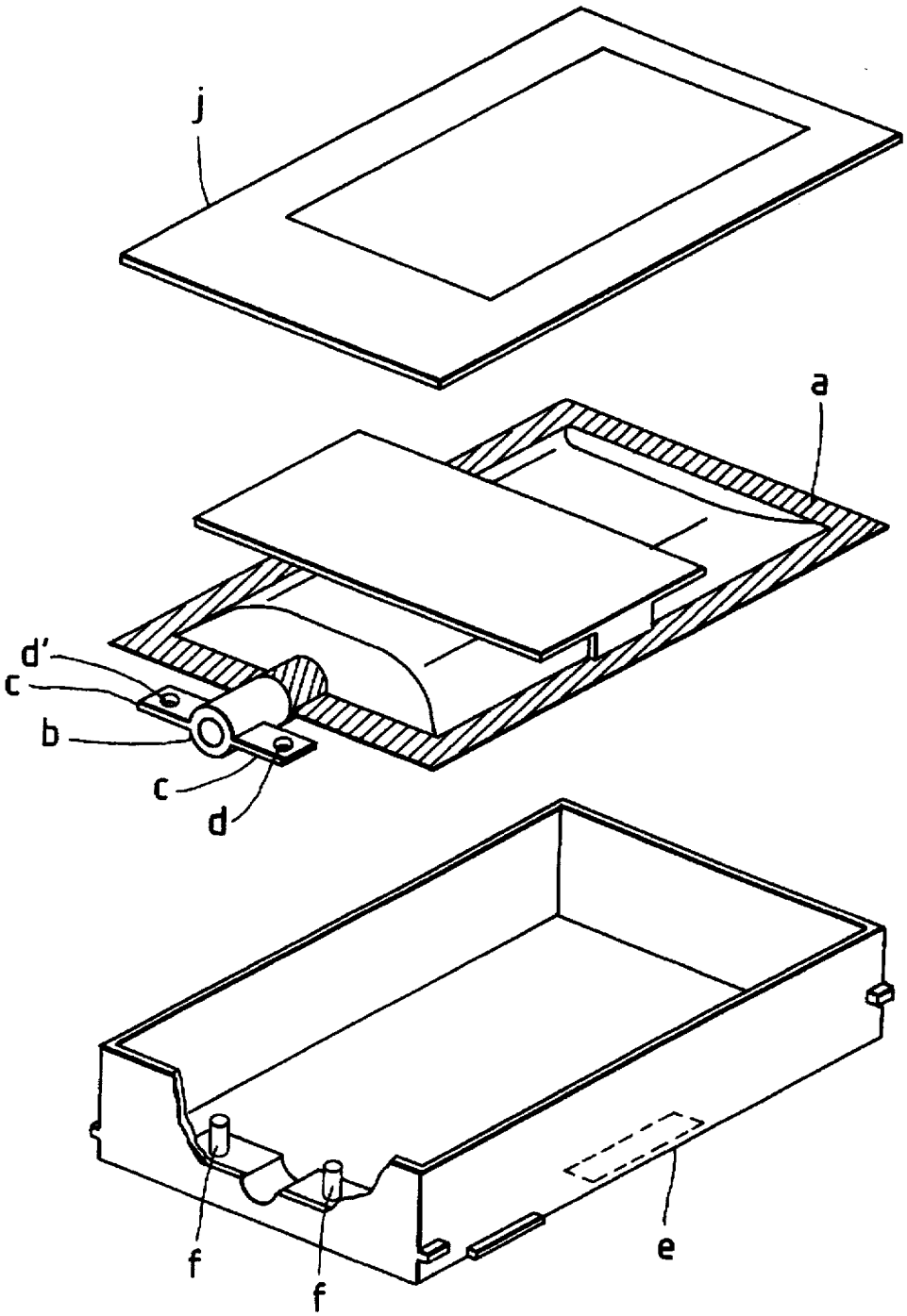
FIG. 7 PRIOR ART
FIG. 7 is a perspective view of a conventional ink cartridge, particularly illustrating the structure of the ink cartridge in a disassembled state.
Figure 8:
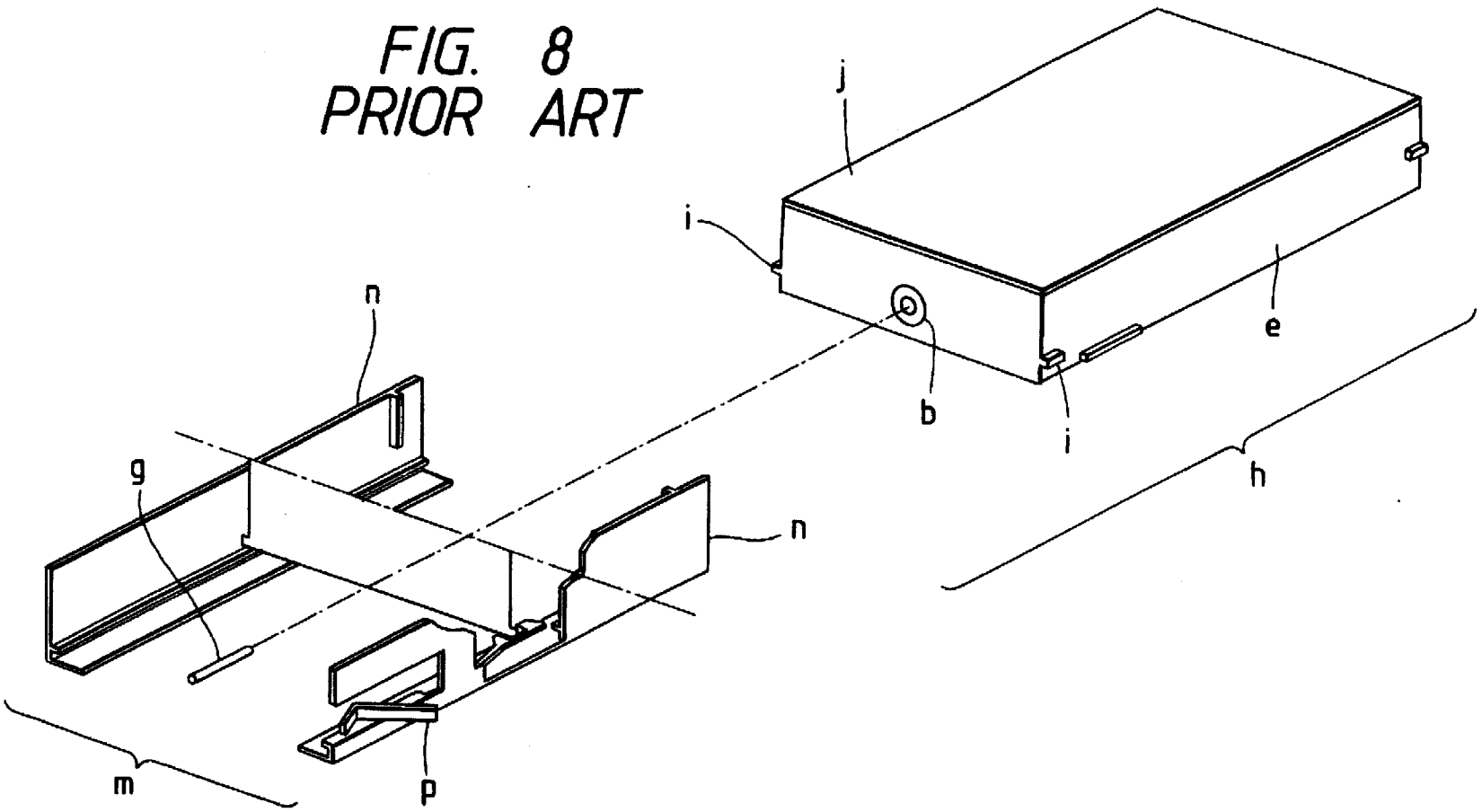
FIG. 8 PRIOR ART
FIG. 8 is a perspective view of the ink cartridge and a holder, particularly illustrating the structure of the holder.

The ink bag 1 is firmly held in position in the case with the aid of a pressure-sensitive-adhesive double-sided tape (hereinafter referred to simply as an adhesive tape), and a detection plate 5, of which the forward end is bent at a right angle, is adhesively attached to the upper surface of the ink bag 1 with the aid of an adhesive tape. As the quantity of the ink in the ink bag 1 decreases, the bent part 5*a* of the detection plate 5 is projected outside of a rectangular hole 4*i* at the lower part of the case 4, whereby a so-called "near-end" state of the ink can be detected by an ink end detector 11, as shown in FIGS. 6(*a*)–6(*c*).

A cover 6 placed on the opening portion of the case 4 includes a pair of projecting portions 6*a* along the front edge thereof, and a pair of pawls 6*b* on the opposite sides at the rear end thereof. Thus, the cover 6 can be firmly fitted to the case 4 in a snap-fit fashion by inserting the corner portions 6*a* into holes 4*d* on the front plate 4 of the case 4 and then fitting the pawls 6*b* into recesses 4*e* on side plates 4*c* of the case 4 at the rear part of the same. When the cover 6 is to be removed from the case 4, it is recommended to insert a jig or other tool into a cutout 4*f* on a rear plate 4*j* of the case 4 and then pry off the cover 6.

A label 7 having a caution instruction or the like printed thereon is adhesively arranged on the cover 6 in such a manner as to hide the cutout 4*f* from the outside. This arrangement prevents not only dislodgment of the cover 6 from the case 4 due to vibration or careless dropping, but also intentional opening of the cover 6.

According to a modified embodiment of the present invention, an ink cartridge may be constructed such that the projecting portions 6*a* and the pawls 6*b* on the cover 6 are eliminated and the cover 6 is firmly held merely by the label 7. In this embodiment, it is necessary that the label 7 be adhesively placed on the case 4 while extending from the front plate 4*a* to the rear plate 4*j* of the case 4. With this construction, the ink cartridge can be provided at a more inexpensive cost.

Next, a mechanism for installing an link cartridge 8 in an ink jet recording apparatus will be described below with reference to FIG. 4.

A holder 9 is fixedly mounted on the ink jet recording apparatus I (not shown). To assure that the ink cartridge 8 is correctly received in the holder 9 and then firmly held at a predetermined position on the holder 9, an opposing pair of frames 10 are arranged for constructing the holder 9. In addition, a shutter 12 is arranged so as to prevent the ink feeding needle 15 projecting into the interior of the holder 9 to touch the user's hand when the ink cartridge is received in the holder 9. The shutter 12 is turnably supported on the holder 9 to turn about a rotational center axis 12*a* so that it normally assumes the position shown by the action of a shutter spring (not shown). While the shutter is in the position shown, it is engaged with pawls of elastically deformable lock arms 10*a* disposed along the lower edges of the frames 10.

The forwardmost end of each of the lock arms 10*a* normally projects into a guide groove 10*b* extending along the lower edge of the frame 10. Thus, when the ink cartridge 8 is inserted midway between both the frames 10, the lock arms 10*a* are squeezed by ribs 4*k* on the opposite sides of the case 4 at the forwardmost end of the same so that they are displaced from the engaged state.

Leaf springs 13 arranged at the innermost ends of the opposing pair of frames 10 project into the region where the ink cartridge 8 is to be received. When the ink cartridge 8 is inserted and reaches the innermost end of the holder 9 while being guided by a position determining shaft 16 and a guide shaft 17, the leaf springs 13 engage with the ribs 4*k* on the case 4, whereby the ink cartridge 8 is firmly held in place.

As is best seen in FIG. 4, the ink feeding needle 15 disposed at the innermost end of the cartridge 9 projects toward the ink cartridge 8 at the position where it is located slightly behind the position determining shaft 16 and the guide pin 17. Thus, when the ink cartridge 8 is firmly retained by the leaf spring 13, the ink feeding needle 15 pierces through the sealing member 3 and the ink outlet piece 2 to reach the interior of the ink bag 1.

In FIG. 4, reference numeral 4w designates ribs which are formed on the opposite side of the case 4 at the rearmost end of the same so as to prevent erroneous insertion of the ink cartridge 8. If the ink cartridge 8 is inserted in the reverse direction by mistake, the ribs 4w collide with erroneous insertion preventing projections 10c on the frames 10, making it impossible for the ink cartridge 8 to be inserted into the holder 8 any further.

Figure 5:
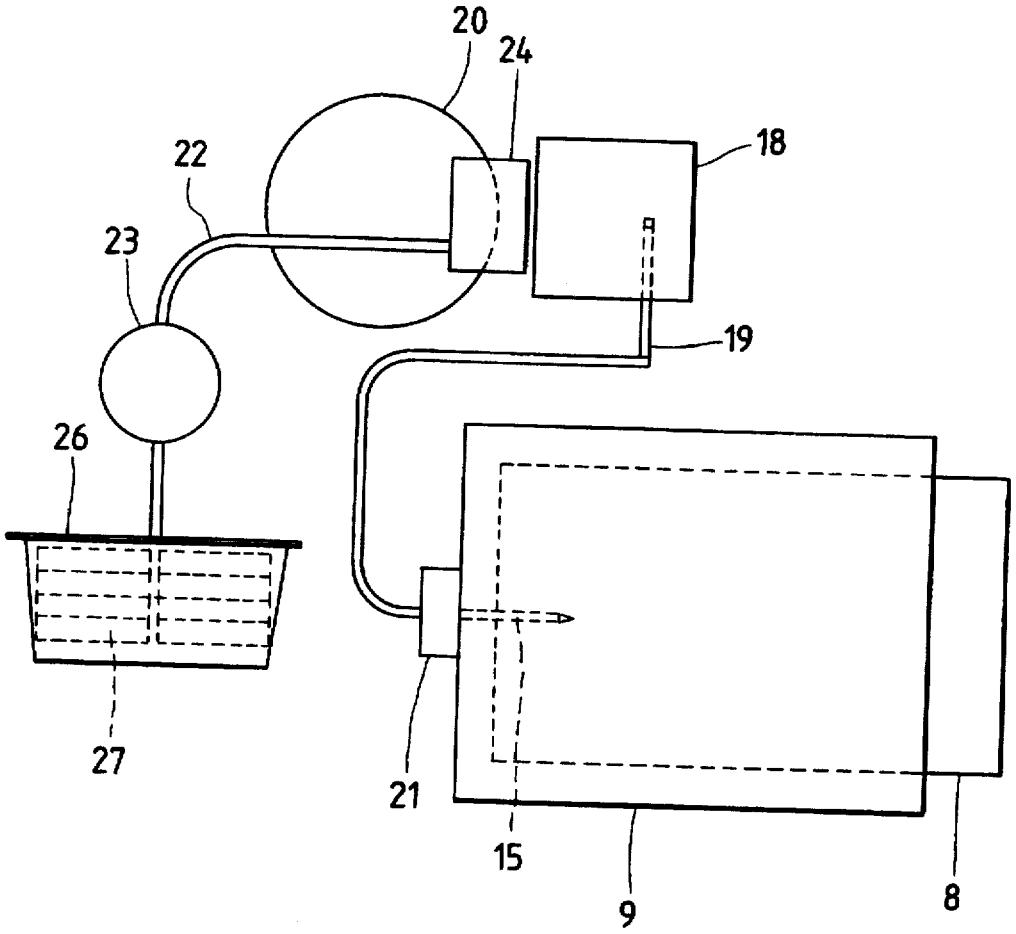
FIG. 5 is a diagrammatic view schematically illustrating an ink flow passage system for the ink jet recording apparatus.

FIG. 5 is a diagrammatic view which illustrates an ink flow passage system for the ink jet recording apparatus.

As shown in the drawing, a filter 21 is arranged on the left-hand end surface of the holder 9 for preventing dust or other foreign material from entering the ink flow passage system. The ink feeding needle 15 is connected to a printing head 18 via the filter 21 and an ink feeding tube 19.

In FIG. 5, reference numeral 24 designates a cap disposed outside of a non-printing region. The cap 24 communicates with a waste liquid bag 26 via a waste liquid tube 22 and a pump 23. When a printing head 18 returns to a waiting position, the cap 24 comes into contact with the nozzle surface of the printing head 18 so that ink remaining in the printing head 18 is recovered in a waste liquid absorbing material 27 in the waste liquid bag 26 so as to prevent the printing head 18 from being clogged with used ink when the ink jet recording apparatus is held in an inoperative state.

Next, the installation of the ink cartridge 8 constructed in the above-mentioned manner will be described below.

The ink outlet piece 2, the rear half of which has a leaf-shaped cross-sectional contour, can be secured to the upper and lower films of the ink bag 1 by thermal fusion not only without any gap therebetween but also without large warpage thereof.

When the ink bag 1 is received in the case 4, the forward half of the ink outlet piece 2 projecting outside of the ink bag 1 is located in alignment with the front plate 4a of the case 4 so as to allow the engagement groove 2a of the ink outlet piece 2 to be engaged with the fitting portion 4b at the central part of the front plate 4a. Thus, the ink bag 1 is located and received at a predetermined position on the case 4 while the front plate 4a of the case 4 serves as a reference Next, the detection plate 5 is adhesively placed on the upper surface of the ink bag 1 using adhesive tape, and thereafter the cover 6 is placed on the case 4. At this time, while the corner portions 6a on the front edge of the plate 4a of the case 4, the rear end part of the cover 6 is depressed with an user's hand, causing the pawls 6b on the opposite sides of the case 4 at the rear end of the same to be engaged with the recesses 4e on the side plates 4c of the case 4. Consequently, the cover 6 is firmly fitted into the opening of the case 4 in the snap-fit fashion.

When the ink cartridge 8 assembled in the above-described manner is received in the holder 9, the ink cartridge 8 having the ink outlet piece 2 located ahead thereof is inserted into the holder 9 by sliding the same along the guide grooves 10b of the frames 10. As the ribs 4k are slidably displaced in this manner, first they deflect the lock arms 10a in the outward direction so as to allow the shutter 12 to be released from the engaged state. Then, the ink cartridge 8 turns the shutter in the upward direction, whereby it is introduced into the holder 7.

When the ink cartridge 8 is inserted to a position in the vicinity of the innermost end of the holder 9, the position determining shaft 16 and the guide shaft 17 horizontally projecting toward the front plate 4a of the case 4 are inserted through the corresponding holes 4g and 4h on the front plate 4a of the case 4 so that the ink cartridge 8 is correctly received in the holder 9 not only in the upward/downward direction but also in the leftward/rightward direction.

Subsequently, when the ink cartridge 8 is squeezed further to contact the innermost end of the holder 9 with the aid of the position determining shaft 16 and the guide shaft 17, the ink feeding needle 15 projecting from the innermost end of the holder 9 pierces the sealing member 3 and the film portion 2d so as to be inserted into the ink bag 1. At this point, the ink contained in the ink bag 1 is ready for use.

While the present invention has been described above with respect to preferred embodiments, various changes and modifications may be made without departure from the scope of the present invention as defined by the appended claims.

What is claimed is:

1. An ink cartridge assembly for an ink jet recording apparatus, comprising:

a case having a front plate, at least one position determining hole being formed in said front plate;

an ink bag containing a supply of ink, said ink bag being received in said case, said position determining hole allowing the insertion of a position determining shaft projecting from the innermost end of a cartridge holder through said position determining hole to guide and properly locate said ink cartridge relative to said cartridge holder in both an upward/downward direction and a leftward/rightward direction without establishing communication between said ink bag and said position determining shaft; and an ink outlet piece having an ink flow path therein communicating with said ink bag so that an ink feeding needle disposed at an innermost end of said cartridge holder and slightly behind said position determining shaft is capable of piercing through said ink outlet piece to reach the interior of said ink bag, said ink outlet piece being positioned to contact said ink feeding needle after said ink cartridge has been properly located relative to said cartridge holder by said position determining hole and position determining shaft.

2. The ink cartridge assembly according to claim 1, wherein said outlet piece comprises an end having an opening therein through which said facilitating shaft is inserted, an ink conduit tube extending along a center axis of said outlet piece, said ink conduit being sealed with a thin film, and a sealing member made of an elastic material, said sealing member being located on a front surface side of said thin film between said end of said outlet piece and said thin film to assure airtightness relative to said facilitating shaft.

3. The ink cartridge assembly according to claim 1, wherein said facilitating shaft is an ink feeding needle.

4. The ink cartridge assembly according to claim 1, further comprising a plate-shaped detection plate arranged in said case, said detection plate being located in a detecting region extending from an upper surface of said ink bag for detecting and indicating an ink near-end state.

5. The ink cartridge assembly according to claim 1, wherein said ink bag comprises a laminated aluminum film comprising an outer nylon film and an inner polyethylene film.

6. The ink cartridge assembly according to claim 1, wherein a rear end portion of said ink outlet piece is thermally fused to said ink bag.

7. The ink cartridge assembly according to claim 1, wherein a forward end portion of said ink outlet piece is circular in cross section, said engagement portion being defined by an annular groove formed in said forward end portion.

8. An ink cartridge assembly as claimed in claim 1, further comprising a label for securing said cover to said casing and covering said opening in said rear plate.

9. An ink cartridge assembly for an ink jet recording apparatus, comprising:

a case having a front plate, at least one position determining hole being formed in said front plate;

a cover for said case, said cover having a pair of pawls formed on opposite sides of a rear end portion thereof, and wherein engagement holes are formed on said front plate of said case so as to be engaged with corresponding projection portions on a front edge of said cover, and wherein recesses are formed on opposite side plates of said case at a rear end of said case so as to be engaged with corresponding ones of said pawls;

an ink bag containing a supply of ink, said ink bag being received in said case, said position determining hole serving to properly locate said ink cartridge relative to a cartridge holder in which said ink cartridge is inserted, in both an upward/downward direction and a leftward/rightward direction, by insertion of a position determining shaft, independent of a shaft for facilitating removal of ink from said ink cartridge and projecting from inside said cartridge holder through said position determining hole, without establishing communication between said ink bag and said position determining shaft and prior to said ink cartridge contacting said facilitating shaft;

a fitting portion formed on said front plate of said case; and an ink outlet piece having an ink flow path therein communicating with said ink bag, said ink outlet piece having an engaging portion engaged with said fitting portion so as to hold and locate said ink outlet piece at a predetermined position relative to said case.

10. The ink cartridge assembly according to claim 9, further comprising a plate-shaped detection plate arranged in said case, said detection plate being located in a detecting region extending from an upper surface of said ink bag for detecting and indicating an ink near-end state.

11. The ink cartridge assembly according to claim 9, wherein said ink bag comprises a laminated aluminum film comprising an outer nylon film and an inner polyethylene film.

12. The ink cartridge assembly according to claim 9, wherein a rear end portion of said ink outlet piece is thermally fused to said ink bag.

13. The ink cartridge assembly according to claim 9, wherein a forward end portion of said ink outlet piece is circular in cross section, said engagement portion being defined by an annular groove formed in said forward end portion.

14. The ink cartridge assembly according to claim 9, wherein said pair of pawls and said projecting portions engage said recesses and said engagement holes, respectively, from the inside of said case outward.

15. The ink cartridge assembly according to claim 9, wherein the case comprises at least one projection which facilitates insertion of said ink cartridge into said cartridge holder.

16. The ink cartridge assembly according to claim 9, further comprising an information label disposed on said cover.

17. The ink cartridge assembly according to claim 9, wherein the case further comprises two side plates, a rear plate and a bottom plate.

18. The ink cartridge assembly according to claim 9, wherein the case is rectangular in shape.

19. The ink cartridge assembly according to claim 9, wherein said outlet piece comprises an end having an opening therein through which said facilitating shaft is inserted, an ink conduit tube extending along a center axis of said outlet piece, said ink conduit being sealed with a sealing member.

20. The ink cartridge assembly according to claim 9, wherein said outlet piece comprises an end having an opening therein through which said facilitating shaft is inserted, an ink conduit tube extending along a center axis of said outlet piece, said ink conduit being sealed with a thin film, and a sealing member made of an elastic material, said sealing member being located on a front surface side of said thin film between said end of said outlet piece and said thin film to assure airtightness relative to said facilitating shaft.

* * * * *